US007654554B1

(12) United States Patent
Scaturro et al.

(10) Patent No.: US 7,654,554 B1
(45) Date of Patent: Feb. 2, 2010

(54) SPORTS BOARD WITH AN INTERLOCKING STRUCTURE

(75) Inventors: Anthony Scaturro, Laguna Niguel, CA (US); Eric Luthardt, Bellevue, WA (US); Roger Neiley, Laguna Beach, CA (US)

(73) Assignee: Goodwell International, Ltd., Tortola (VG)

( * ) Notice: Subject to any disclaimer, the term of this patent is extended or adjusted under 35 U.S.C. 154(b) by 0 days.

(21) Appl. No.: 11/743,452

(22) Filed: May 2, 2007

Related U.S. Application Data

(60) Provisional application No. 60/797,113, filed on May 2, 2006.

(51) Int. Cl.
*A63C 5/00* (2006.01)

(52) U.S. Cl. ..... 280/610; 280/601; 280/602; 280/607; 280/609; 280/14.21; 280/14.22

(58) Field of Classification Search ..... 280/601–610
See application file for complete search history.

(56) References Cited

U.S. PATENT DOCUMENTS 3,776,563 A * 12/1973 Tigert ..... 280/602
3,801,116 A * 4/1974 Benner ..... 280/610
3,825,360 A * 7/1974 Galich ..... 403/294
4,723,789 A * 2/1988 Schmidt ..... 280/603
5,788,259 A * 8/1998 Emig ..... 280/609
5,988,668 A * 11/1999 DeVille et al. ..... 280/602
6,293,567 B1 * 9/2001 Menges ..... 280/14.21
6,349,961 B1 * 2/2002 Colley et al. ..... 280/608
6,848,703 B2 * 2/2005 Godde et al. ..... 280/607
2003/0127831 A1 * 7/2003 Wimbish et al. ..... 280/609

FOREIGN PATENT DOCUMENTS

DE 3319889 A * 12/1984

* cited by examiner

*Primary Examiner*—Paul N Dickson
*Assistant Examiner*—Katy Meyer
(74) *Attorney, Agent, or Firm*—Fred C. Hernandez; Mintz, Levin, Cohn, Ferris, Glovsky, and Popeo P.C.

(57) ABSTRACT

A sports board, such as a snow board, has a board core structure that provides desired structural characteristics localized to select regions of the board while maintaining predictable produceability and optimum operating qualities of the board. In an embodiment, the sports board includes a plurality of layered elements or segments, of which certain elements or segments are joined using interlocking elements.

12 Claims, 3 Drawing Sheets

SPORTS BOARD WITH AN INTERLOCKING STRUCTURE

REFERENCE TO PRIORITY DOCUMENT

This application claims priority of U.S. Provisional Patent Application Ser. No. 60/797,113 filed May 2, 2006. Priority of the aforementioned filing date is hereby claimed and the disclosure of the Provisional Patent Application is hereby incorporated by reference in its entirety.

BACKGROUND

Disclosed is a specially-configured board for gliding along terrain, such as a snowboard, snow ski, water ski, wake board, kite board, surf board, skateboard and the like. Although described herein in the context of snowboarding, it should be appreciated that a "board" described herein will refer generally to any of these sorts of boards as well as to other board-type devices which allow a rider to traverse a solid or fluid surface.

A snowboard includes a tip, a tail, and opposed side edges. The width of the board typically tapers inwardly from both the tip and tail towards the central region of the board, facilitating turning and edge grip. A rider typically has an asymmetrical position with respect to the board and with respect to the slope. The rider has two support points on the board, and, by a differential action of both boots, the rider can effect flexural or torsional shape changes to the board to aid in control.

Size, shape and materials used in construction of the board vary depending upon the desired riding qualities. Since snowboarding is a very dynamic sport, material characteristics and interactions play a significant role in determining overall performance as well as suitability for specific applications.

Although it is difficult to optimize all of the many different parameters in a board to obtain optimum gliding, maneuverability and operational qualities, materials can be added to the board during construction to mitigate forces that adversely impact board structure and operating qualities. For example, materials can be inserted which facilitate the attachment of bindings or provide strength to the board at the sites of binding attachment. Other materials can be inserted to reduce vibration traveling through the board. However, the resulting parameters are mutually connected and variation of one parameter due to the use of a particular material can directly or indirectly modify another parameter of the board, often to the detriment of the operating qualities.

Board construction techniques known in the art originate from the construction of conventional skis, and include various methods including the use of injected cores and the lamination of various structural components. These techniques all require some type of "active" pressing and curing of the structure under pressure. Such techniques of board construction can lead to shifting of materials added for their particular structural characteristic. This can result in points of weakness, inconsistency from one finished item to the next and/or an unpredictable operational quality of the board.

SUMMARY

In view of the foregoing, there is a need for a board core structure that provides desired structural characteristics localized to select regions of the board while maintaining predictable produceability and optimum operating qualities of the board.

In one aspect, there is disclosed a sports board, comprising a plurality of layered elements or segments, of which certain elements or segments are joined using interlocking elements. In another aspect, there is disclosed a sports board, comprising: an elongated base; and an interlocking structure including: (a) a central bridge; and (b) interlocking segments positioned on opposed regions of the central bridge, the interlocking segments adapted to interlock with the opposed regions of the central bridge so as to maintain the central bridge and interlocking segments in a substantially fixed orientation with respect to one another.

The details of one or more embodiments are set forth in the accompanying drawings and the description below. Other features, objects, and advantages will be apparent from the description and drawings, and from the claims.

DETAILED DESCRIPTION

Provided herein is a board with an interlocking design of certain structural elements that are used to localize structural and dynamic properties to regions of the board. Certain regions of the board benefit from a particular structural characteristic, whereas the presence of that same structural characteristic at other regions of the board can have a negative or undesired impact on the board's performance. As described in more detail below, provided herein is a board that is tuned to one or more specific, localized stresses or to a combination of such localized stresses by way of an interlocking structure containing a plurality of materials.

Figure 1:
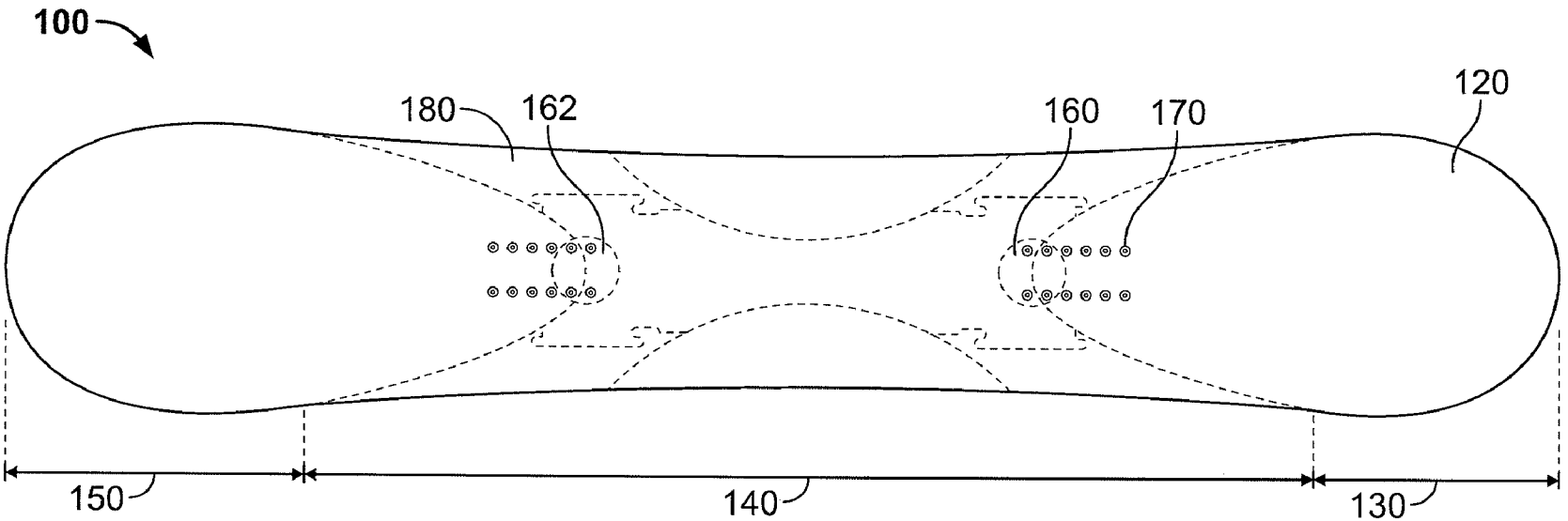
FIG. 1 shows a plan view of a snowboard including an interlocking board structure.

FIG. 1 shows a plan view of an exemplary embodiment of a snowboard 100 including the interlocking structure 180. The snowboard 100 comprises a long base structure 120, which can be symmetrical with respect to a vertical and longitudinal plane or asymmetrical. The base 120 of the snowboard 100 is shown in FIG. 1 as divided into a front zone 130, a central zone 140 and a rear zone 150. The central zone 140 of the snowboard 100 has two mounting zones 160 and 162 schematized in the form of two circles. The diameter of these mounting zones 160 and 162 can be slightly less than the width of the base structure 120 in this area. Within the mounting zones are a plurality of binding fasteners or inserts 170. Bindings can have a center disc inside each baseplate with holes that align with the inserts 170 on the snowboard. The baseplates are fixed by screwing into a pair of binding inserts 170 within each mounting zone.

The central zone 140 also includes an interlocking structure 180. The various shear, compressive, tensile and torsional stresses a board undergoes during a ride may not be applied uniformly across the board but, rather, localized regions may be subject to a greater magnitude of a particular load. Thus, the interlocking structure 180 can be constructed of a plurality of materials with different structural characteristics that are particularly well-suited for their location in the board. The interlocking structure includes two or more element, that interlock with one another. In addition, at least a portion of the interlocking structure can interlock with any other component of the board's construction.

Figure 2:
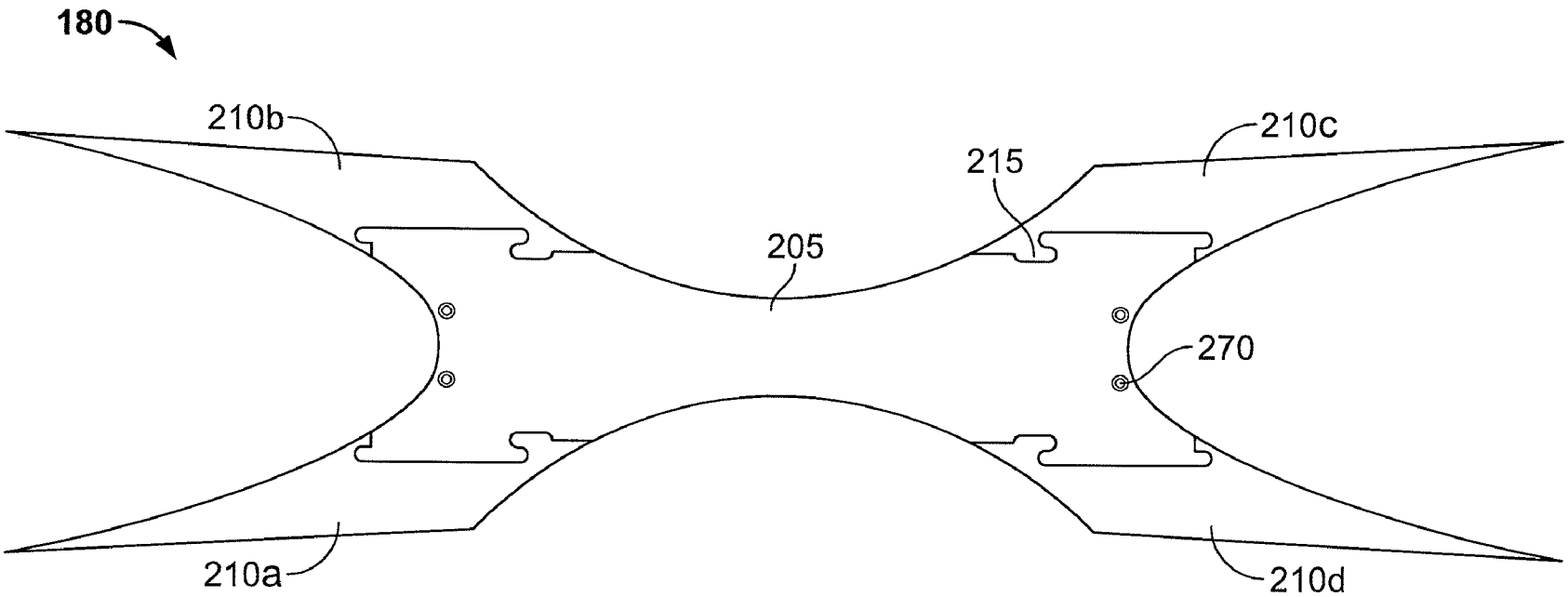
FIG. 2 shows a top view of the interlocking board structure shown in phantom lines in FIG. 1.

As described above, the size and shape of a board as well as the materials used in the construction of the board can vary depending on the qualities needed for the board and the different snowboarding activities to be performed. It can therefore be desirable to insert an interlocking structure that is constructed of a plurality of materials, wherein the materials can be selected and positioned on the board to provide localized structural characteristics to the board. FIG. 2 shows a more detailed view of an exemplary embodiment of an interlocking structure 180. The interlocking structure 180 includes a bridge 205 and lateral interlocking segments, 210*a*, 210*b*, 210*c* and 210*d*. In the illustrated embodiment, the bridge 205 is positioned centrally between the four interlocking segments 210. The bridge 205 is substantially elongated. The interlocking segments are coupled to either end of the bridge 205 on opposed, lateral edges of the bridge 205. As discussed below, the bridge 205 and interlocking segments 210 have complimentary engagement regions and are shaped so as to form an interlocking arrangement. The bridge 205 and the interlocking segments 210 collectively form a substantially X-shaped assembly with lateral edges that taper toward a point.

The bridge 205 and interlocking segments 210 can be comprised of different materials. As mentioned above, the material chosen for each segment of the interlocking structure 180 is selected based on the structural property desired such that one structural quality is localized to a particular region of the board.

As mentioned above, the materials of the bridge 205 and interlocking segments 210 are selected to provide localized structural characteristics to particular regions of the board. The structural characteristics of one segment do not necessarily affect the structural characteristics of an adjacent segment. For example, the bridge 205 can be manufactured of a material that is particularly suited for the central region of the board. The bridge material desirably has characteristics that support a lively feel in the central region of the board. The bridge material can be highly resilient and can exhibit high rebound characteristics. In one embodiment, the bridge is made of a woven fiberglass material.

Still with reference to FIG. 2, the bridge 205 and interlocking segments 210 of the core structure 180 have scalloped edges. These scallops 215 interlock with one another at each segment junction thereby forming a unitary structure 180. The scallops 215 at each junction maintain the bridge 205 and the interlocking segments 210 in a fixed orientation or substantially fixed orientation with respect to each other. The bridge 205 includes inserts 270. During manufacturing, pins can be placed through the inserts 270 to prevent shifting or movement during the curing stage. This maintains the core structure 180 in a fixed orientation with respect to the axes of the board. The interlocking scallops 215 assure that such secondarily connected components not directly positioned using pins will be unlikely to shift in position during the curing process.

Figure 3A:
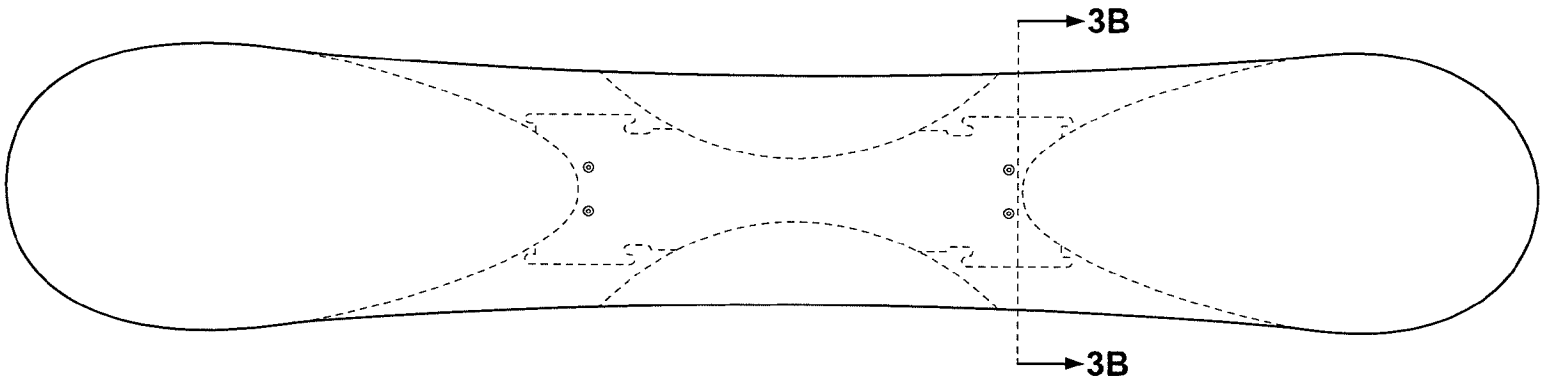
FIG. 3A shows a top view of the snowboard shown in FIG. 1.
Figure 3B:
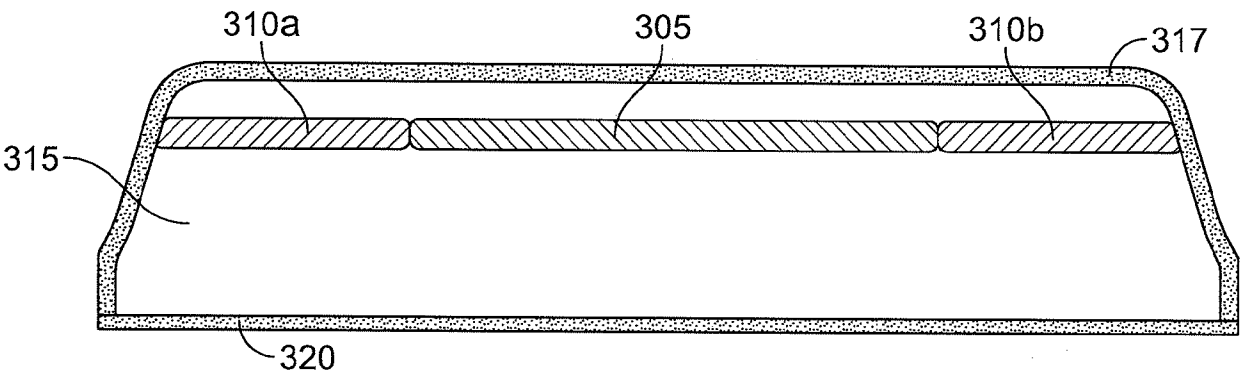
FIG. 3B shows a cross-sectional view of the snowboard shown in FIG. 3A taken along line B-B.

FIG. 3B shows a cross-section view of the snowboard in FIG. 3A taken along line B-B. In this embodiment, the board has a central structure 315 enveloped on the top and sides by a reinforcement laminate 317 and a running base 320. Inside the structure 315 are interlocking components, including a bridge 305 and lateral interlocking segments 310*a* and 310*b*. The board can be manufactured of various materials and using various methods. It should be appreciated that the cross-section shown in FIG. 3A is merely exemplary and that other configurations can be used.

The board including the structure described herein provides advantages over other boards. The core structure described herein provides a board with both strength and flexibility in a localized fashion to meet desired performance parameters.

Although embodiments of various methods and devices are described herein in detail with reference to certain versions, it should be appreciated that other versions, embodiments, methods of use, and combinations thereof are also possible. Therefore the spirit and scope of the disclosure should not be limited to the description of the embodiments contained herein.

What is claimed is:

1. A sports board, comprising a top layer having a first mounting zone that receives a first boot binding and a second mounting zone that receives a second boot binding;

a bottom layer;

an internal layer interposed between the top layer and the bottom layer such that the internal layer is entirely surrounded by the top layer and bottom layer; wherein the internal layer comprises an X-shaped structure including:

(a) a central bridge positioned in a central region of the sports board;

(b) a first segment interlocked to a first longitudinal end region of the central bridge, the first segment extending laterally outward toward a first lateral edge of the sports board and terminating adjacent to the first lateral edge;

(c) a second segment interlocked to the first longitudinal end region of the central bridge, the second segment extending laterally outward toward a second lateral edge of the sports board opposite the first lateral edge and terminating adjacent to the second lateral edge;

(d) a third segment interlocked to a second longitudinal end region of the central bridge opposite the first longitudinal end region, the third segment extending laterally outward toward the first lateral edge of the sports board and terminating adjacent to the first lateral edge;

(e) a fourth segment interlocked to the second longitudinal end region of the central bridge, the fourth segment extending laterally outward toward the second lateral edge of the sports board and terminating adjacent to the second lateral edge.

2. The sports board of claim 1, wherein the central bridge is made of a first material and the segments are made of a second material.

3. The sports board of claim 1, wherein the segments have tapered edges that are positioned adjacent to lateral edges of the sports board.

4. The sports board of claim 1, wherein the sports board is a snowboard.

5. The sports board of claim 1, wherein the first and second segments are positioned adjacent a first mounting zone that includes a first load bearing location for a user's foot and the third and fourth interlocking segments are positioned adjacent a second mounting zone that includes a second load bearing location for a user's foot such that each load bearing location is at least partially positioned atop an interlocking segment.

6. A sports board, comprising:

an elongated base having a top layer and a bottom layer; and an internal layer positioned between the top layer and the bottom layer and including an interlocking structure comprising:

(a) a central bridge; and (b) first and second interlocking segments positioned on and interlocked with a first end region of the central bridge, the first and second interlocking segments forming a pair of arms that extend diagonally outward toward lateral edges of the snowboard;

(c) third and fourth interlocking segments positioned on and interlocked with a second end region of the central bridge, the first and second interlocking segments forming a pair of arms that extend diagonally outward toward lateral edges of the snowboard.

7. The sports board of claim 6, wherein the interlocking segments and the central bridge are collectively shaped such that the interlocking structure is X-shaped.

8. The sports board of claim 6, wherein the central bridge is made of a first material and the interlocking segments are made of a second material.

9. The sports board of claim 8, wherein the interlocking segments have tapered edges that are positioned along lateral edges of the sports board.

10. The sports board of claim 6, wherein the sports board is a snowboard.

11. The sports board of claim 6, wherein the top layer of the elongated base comprises a first mounting zone that receives a first boot binding and a second mounting zone that receives a second boot binding.

12. The sports board of claim 11, wherein the first pair of interlocking segments are positioned adjacent the first mounting zone that receives the first boot binding and the second pair of interlocking segments are positioned adjacent the second mounting zone that receives the second boot binding.

* * * * *